US009885547B1

(12) United States Patent
Harris et al.

(10) Patent No.: US 9,885,547 B1
(45) Date of Patent: Feb. 6, 2018

(54) TARGET WITH INDICIA

(71) Applicant: TS Founders, LLC, St. Louis, MO (US)

(72) Inventors: Kenneth William Harris, St. Louis, MO (US); Jared Wallace Ogden, II, St. Louis, MO (US); Aaron Paul Brookhart, St. Louis, MO (US); Brandon Thomas Hefer, St. Louis, MO (US)

(73) Assignee: TS Founders, LLC, St. Louis, MO (US)

( * ) Notice: Subject to any disclaimer, the term of this patent is extended or adjusted under 35 U.S.C. 154(b) by 0 days.

(21) Appl. No.: 15/224,551

(22) Filed: Jul. 30, 2016

Related U.S. Application Data

(60) Provisional application No. 62/198,701, filed on Jul. 30, 2015, provisional application No. 62/198,721, filed on Jul. 30, 2015.

(51) Int. Cl.
*F41J 5/24* (2006.01)
*F41J 5/22* (2006.01)
*F41J 5/20* (2006.01)

(52) U.S. Cl.
CPC ..... *F41J 5/22* (2013.01); *F41J 5/205* (2013.01); *F41J 5/24* (2013.01)

(58) Field of Classification Search
CPC ..... F41J 5/24
USPC ..... 273/378, 403–410
See application file for complete search history.

(56) References Cited

U.S. PATENT DOCUMENTS

| | | | | |
|---|---|---|---|---|
| 3,330,561 | A * | 7/1967 | Kandel | F41J 5/00 273/378 |
| 3,895,803 | A * | 7/1975 | Loe | F41J 1/01 273/378 |
| 4,243,228 | A | 1/1981 | Marcella | |
| 5,174,581 | A | 12/1992 | Goodson | |
| 5,188,371 | A * | 2/1993 | Edwards | F41J 1/01 273/378 |
| 5,501,467 | A | 3/1996 | Kandel | |
| 5,580,063 | A * | 12/1996 | Edwards | F41J 1/01 273/378 |
| 7,631,877 | B2 * | 12/2009 | Zara | F41J 1/00 273/378 |

(Continued)

OTHER PUBLICATIONS

Chesapeake Police Fundamentals Target [online]. Law Enforcement Targets, Inc. Retrieved from the Internet: <URL:www.letargets.com/content/dt-cpd-chesapeake-police-fundamentals-target.asp>.

(Continued)

*Primary Examiner* — Mark Graham
(74) *Attorney, Agent, or Firm* — Creativenture Law, LLC; Dennis J M Donahue, III

(57) ABSTRACT

A target has a body with an internal indicia and external indicia and a top portion which is opposite from the target base and surrounds one or more apertures. The internal indicia provide the target with a visual indicator upon impact and adaptable uses. The external indicia aid in identifying the target for use in cognitive shooting drills. The aperture has an axis that is perpendicular to the centerline of the body, and the target base and apertures opposite from the target base allow the marksman to stand the target on its own, secure it to an object, or suspend the target from an object.

20 Claims, 7 Drawing Sheets

(56) References Cited

U.S. PATENT DOCUMENTS

| | | | | |
|---|---|---|---|---|
| 8,556,268 | B2 * | 10/2013 | Su | F41J 1/01 273/378 |
| 8,596,643 | B1 * | 12/2013 | Edwards | F41J 5/00 273/378 |
| 2007/0262529 | A1 * | 11/2007 | Gamez | F41J 5/00 273/409 |
| 2008/0277875 | A1 | 11/2008 | Mincenberg | |
| 2013/0228974 | A1 * | 9/2013 | Davis, Jr. | F41J 5/24 273/378 |
| 2014/0175746 | A1 * | 6/2014 | Fife | F41J 5/20 273/378 |
| 2015/0001802 | A1 * | 1/2015 | Sharrock | F41J 5/24 273/380 |
| 2016/0313096 | A1 * | 10/2016 | Broadbent | F41J 1/01 |
| 2016/0327377 | A1 * | 11/2016 | Flynn | F41J 5/205 |

OTHER PUBLICATIONS

Cognitive Stress Drills | Hammerhead Combat Systems [online]. Hammerhead Combat Systems, Mar. 24, 2014. Retrieved from the Internet: <URL:https://hcstx.org/tag/cognitive-stress-drills/>.

* cited by examiner

TARGET WITH INDICIA

CROSS-REFERENCE TO RELATED APPLICATIONS

This application claims priority from U.S. Provisional Patent Application Nos. 62/198,721 and 62/198,701, both of which had been filed on Jul. 30, 2015 and which are hereby incorporated by reference.

STATEMENT REGARDING FEDERALLY SPONSORED RESEARCH

Not Applicable.

APPENDIX

Not Applicable

BACKGROUND OF THE INVENTION

Field of the Invention

The present invention relates to a shooting target for use with firearms, archery and other projectiles which discharges a visual indicator upon impact of a projectile. Also disclosed herein are methods of use of the target apparatuses.

Related Art

Target practice is a method that is used to increase marksmanship. By using targets, marksmen can improve their accuracy and precision in a controlled environment. Conventional targets are two-dimensional and are made of paper. These types of targets are commonly found at shooting ranges with a printed pattern of concentric circles with a bulls-eye. An issue with these paper targets is that it is difficult to see where the target was hit. For this reason, shooting ranges often have a mechanism to bring the target closer for viewing. The common pattern also doesn't provide a marksman with the need to adapt their aim, coordinate timed drills, and create cognitive shooting drills.

Cognitive shooting drills are an important aspect of increasing the skill of a marksman. Current targets do not provide a marksman of the need to specifically neutralized certain targets that have been identified by markings either by the marksman themselves or another marksman. Current technology includes applications that give instructions on a shooting drill, and time the marksman, however, they do not differentiate and identify which target to neutralized.

Other targets consist of a three-dimensional shape that are often cubed or shaped like an animal. These targets have a rigid stable structure and do not require a marksman to adapt their aim since the target is designed not to change shape or move. Other three-dimensional targets that are commonly used are glass bottles and aluminum cans. Although the rigid structure of these items change upon impact by shattering, it creates harmful debris and introduces non-biodegradable material into the environment.

Targets are generally made to be stabilized in one form or the other. Traditional paper targets are created to be fitted into a holder at a gun range or fixed to another object. Other kinds of targets are created to form fit into a specially created stand. Some targets contain holes that allow a marksman to attach the target to another object. However, these holes are usually supported by an external tab from the target and do not provide proper stability to display the target in a necessary manner.

None of the prior art references discloses a target having multiple indicators of impact. Further, the prior art references do not have adjustable indicia located on the exterior of the targets that induce cognitive drills. While targets generally have an indicator in the form of the bullseye, all visual stimuli are usually only located on the exterior of the target. Also, the printed patterns on the target makes where a marksman aims static, whereas in practice a marksman is dealing with a dynamic target.

SUMMARY OF THE INVENTION

A target with a base, a front, a back, sides, a top, and a visual indicator. The visual indicator provides visual stimuli, aids in the structure for the target, and is visible when the target is in a fractured state. The target is also comprised of indicia on the exterior that create cognitive firearm drills.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

DETAILED DESCRIPTION OF THE PREFERRED EMBODIMENTS

Figure 1B:
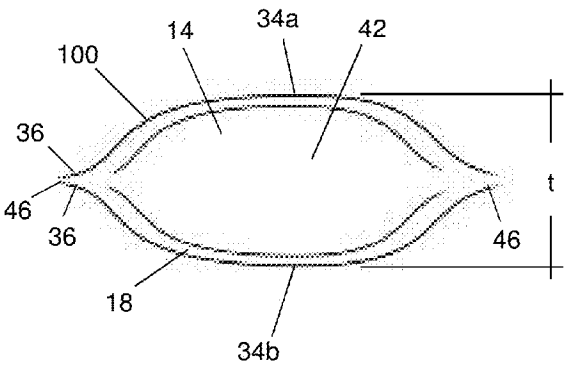
FIGS. 1A and 1B respectively show a front view and a bottom view of the target with flexible sides.
Figure 1A:
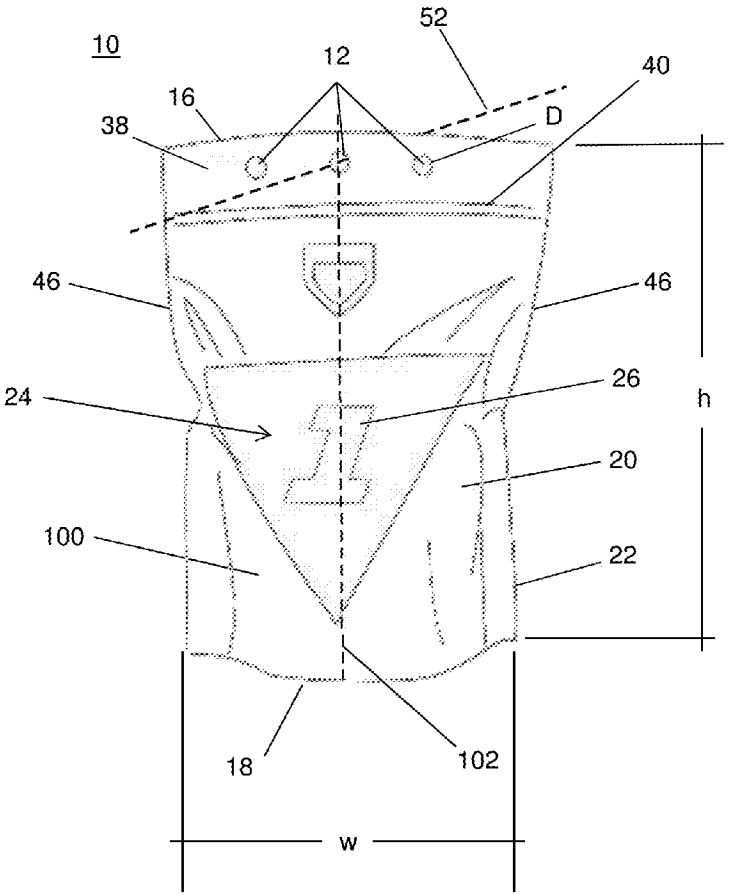

The following description of the preferred embodiment(s) is merely exemplary in nature and is in no way intended to limit the invention, its application, or uses.

As generally shown in FIGS. 1, 2, 4, 5 and 6, the target 10 has a body 100 with an exterior 22*a* and interior 22*b*, a base 18 that provides the support for the target 10, and sides 20. The body is comprised of an impact-fracturable material 22 with an internal indicia 14 that provides visual feedback to a marksman when the target is hit. An external indicia 24 can also be either attached to or formed directly on the exterior of the body. In one aspect of the invention, one or more apertures 12 extend through the body 100 below the top 16 of the body. The width (w) of the target is preferably more than half the height (h) of the target, and the thickness (t) of the target is preferably more than the diameter (D) of the apertures. Generally, the aperture 12 has an axis 52 that is perpendicular to the centerline 102 of the body 100 which extends from the base 18 to the top 16 of the target 10. The support around the aperture 12 is a strip 38 at the top of the body that extends along the sides across the width (w), providing stability when securing or suspending the target from an object.

Figure 1D:
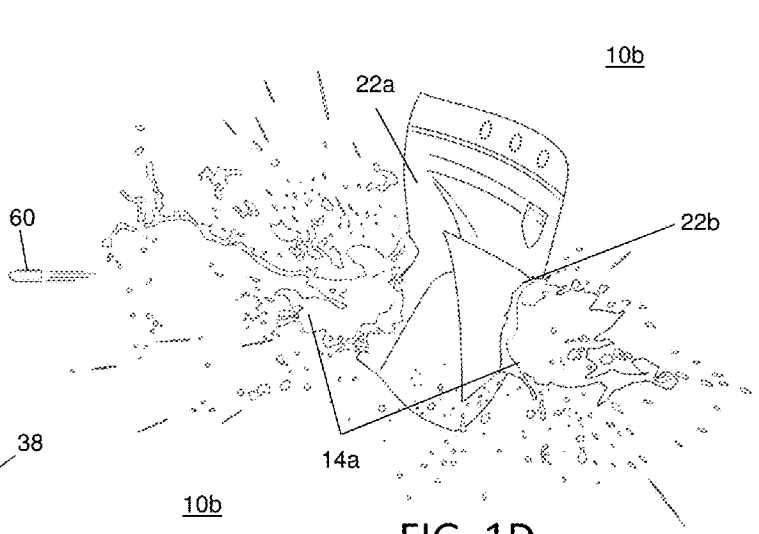
FIGS. 1D and 1E respectively show an isometric view and a cross-sectional side view of the target in a fractured state after having been burst by a projectile.
Figure 1C:
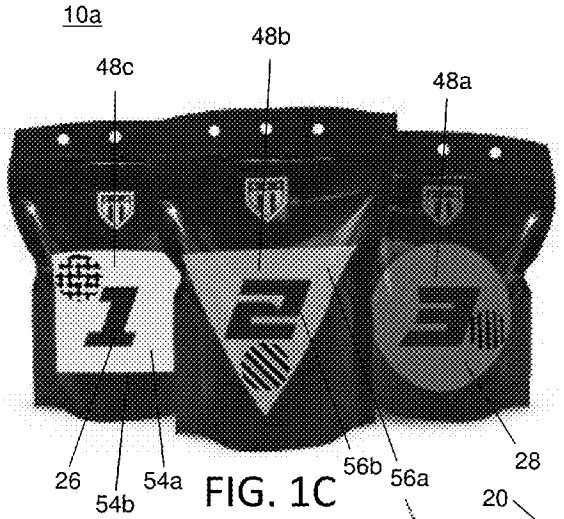
FIG. 1C shows multiple targets according to the target embodiment shown in FIG. 1A with alternative forms of indicia.

FIGS. 1A, 1B, and 2-6 depict the target in an intact state 10*a*. In FIG. 1C, alternative forms of indicia are shown for targets that are formed from plies 34 of a flexible membrane which contain a brightly colored liquid 14*a*. In a first embodiment, the front ply 34*a* has a transparent window 54*a* that is surrounded by an opaque frame 54*b*, and an alphanumeric sticker 26 is adhered to the front ply over a portion of the transparent window. In this embodiment, the brightly colored liquid is visible through the transparent window. In a second embodiment, the entire front ply 34*a* has a preprinted colored shape 56*a* with a preprinted alphanumeric character 56*b*. It will be appreciated that the preprinted alphanumeric character could be printed on a portion of the transparent window in the first embodiment. In a third embodiment, a sticker with a colored shape 28 is adhered to the front ply. In this embodiment, it will be appreciated that a preprinted alphanumeric character could be printed on a portion of the colored shape sticker or a separate sticker with the alphanumeric character can be placed over a portion of the colored shape sticker. As evident from these embodiments and their use for cognitive shooting drills, the targets can be configured as a multivariable training platform, with different shapes that are may be provided on separate stickers or preprinted on the front ply or formed as a transparent window in the front ply, different colored liquids that are visible through the transparent window or different colors provided on the different shaped stickers or the different shapes on the preprinted front ply, and different alphanumeric characters that may either be on stickers or preprinted on the front ply.

Figure 1E:
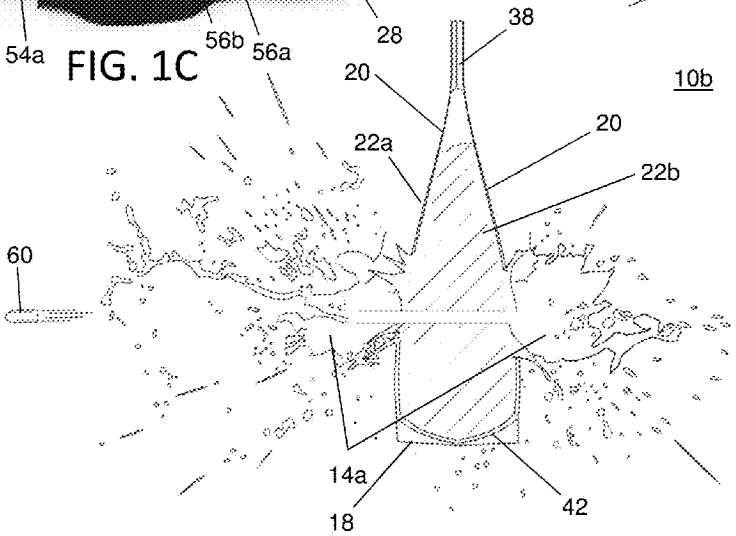

Regardless of the particular embodiment of the target 10, the multivariable colors, shapes, and alphanumeric characters provide distinctive features for call-out drills in which the marksman must select the proper target from a group of targets. When the target 10 is punctured by a projectile 60, the internal indicia 14 is exposed to the exterior 22*a*, providing a visual indicator to the marksman that confirms a successful shot. FIGS. 1D and 1E illustrate a target in a fractured state 10*b* following an impact of a projectile 60. The projectile 60 penetrates the target wherein the internal indicia 14 is forcibly ejected and the marksman is provided with a visual stimulus indicating that the target has been destroyed.

Internal indicia 14 may be any number of substances including but not limited to a liquid, gel, gas, powder, clay, sparkles, confetti, glitter, rice, sand, and/or free floating or suspended fibers having a reflective quality. The internal indicia can be a fluid 14*a* that splatters about the area of the target and subsequently provides a visual stimulus for the marksman. Although the sides 20 of the body shown in FIG. 1 are preferably formed from plies of a flexible membrane, it will be appreciated that the sides could also be formed from thicker sheets of plastic or some other fracturable material to produce a rigid shell or wall around the interior of the body.

The internal indicia 14 may include a pressurized gas causing the target to pop when breached, subsequently creating a "boom" and providing an auditory signal that the target has been impacted. The gas can be used in combination with a liquid or it may be used on its own, such as in an inflated pouch. An inflated pouch may be filled with pressurized ambient air or with some lighter-than-air gas, such as helium, which allows the target to float when held by a string and can provide the marksman with a moving target. In another embodiment, the internal indicia 14 is the interior membrane 22*b* of the body. The interior 22*b* may have shiny, fluorescent, bright, reflective or other indicia wherein the interior is noticeably exposed after the target 10 is punctured by a projectile 60. Further, the aforementioned embodiments of the internal indicia 14 may be combined to provide multiple internal indicators within the same target. The internal indicia is preferably colored so that when the target is punctured, the fluid internal indicia 14*a* creates a splatter effect. Solid internal indicia 14*b*, as seen in FIG. 2, provides a stronger structure for the target and breaks apart when the target is punctured.

Figure 3A:
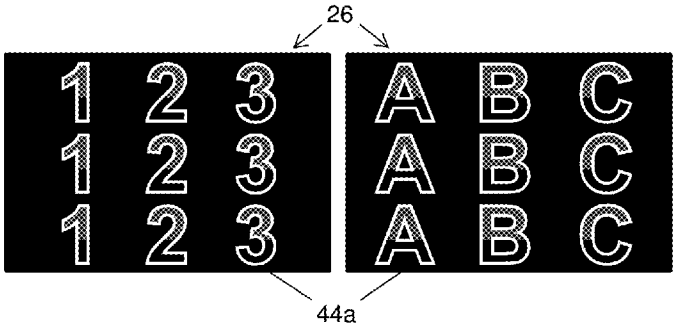
FIGS. 3A and 3B show stickers having different types of external indicia.
Figure 3B:
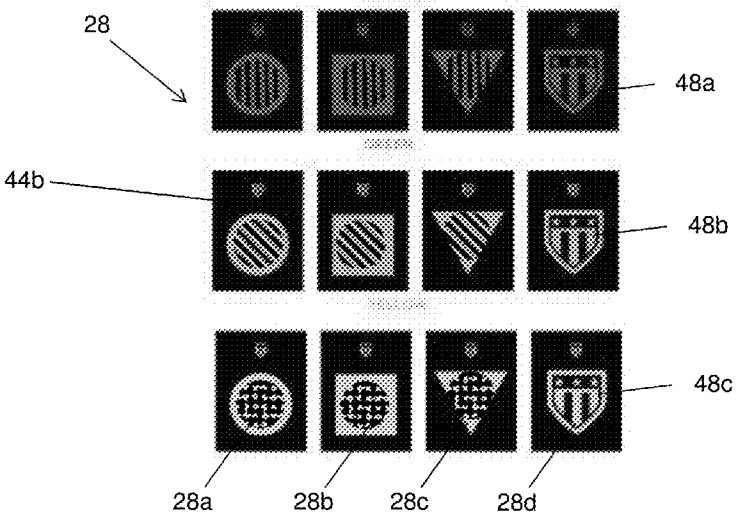
Figure 5B:
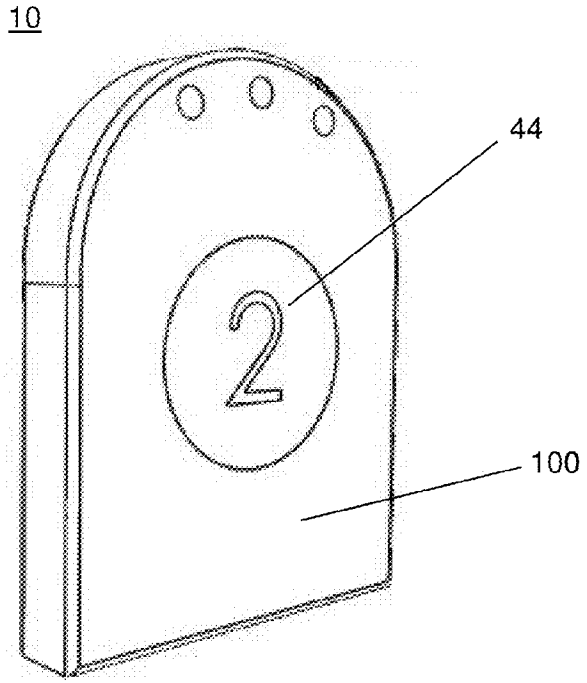
FIGS. 5A and 5B show external indicia being applied to the rigid target.
Figure 5A:
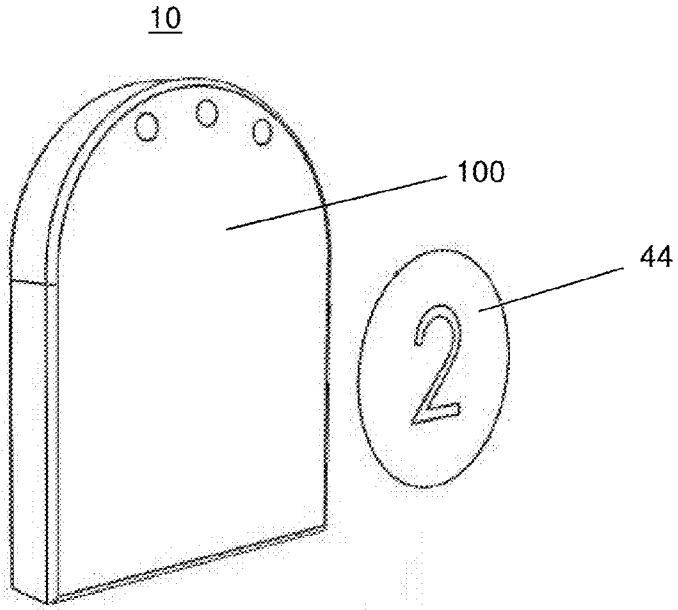
Figure 6A:
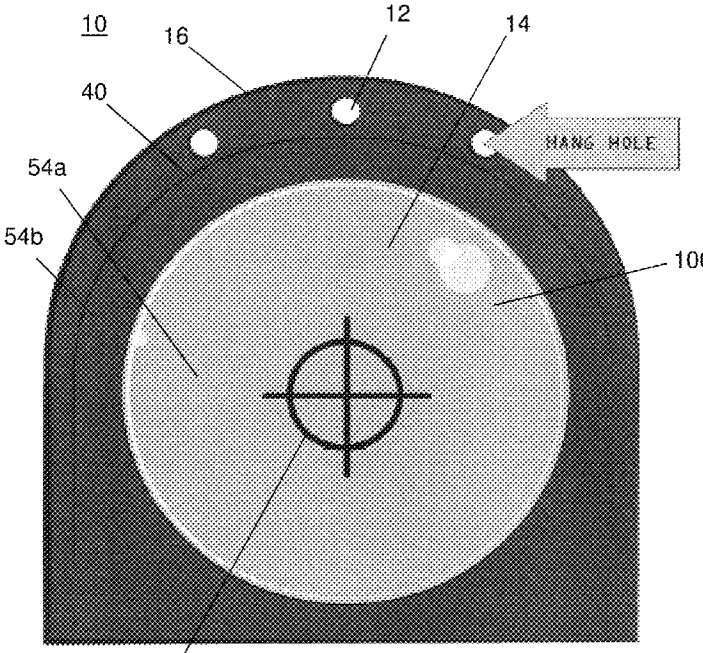
FIGS. 6A and 6B respectively show a perspective view and a side view of an alternative target having a transparent flexible membrane.
Figure 6B:
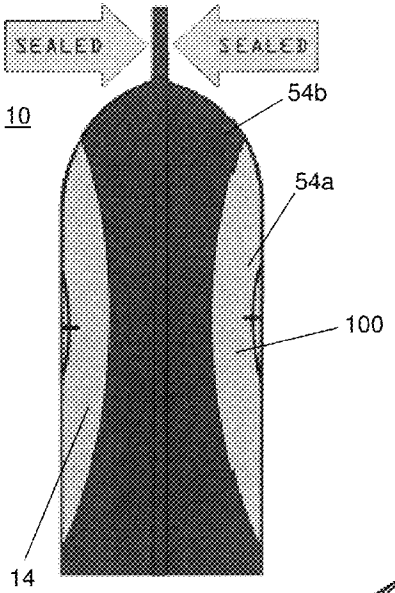

The targets are further comprised of external indicia 24 that either is printed directly on or is adhered to the exterior of the targets. As indicated above, the external indicia 24 may be printed onto the sides of the target or onto stickers that are affixed to the sides of the target. Exemplary sheets of stickers 26, 28 are shown in FIGS. 3A and 3B. The stickers may be adhered to the targets as shown in FIGS. 1C, 5A and 5B. The external indicia 24 can come in a variety of visual indicators such as an alphanumeric character 26, a shape 28, a color 48, a bullseye, an aiming grid, and a crosshair 58. As indicated above with reference to FIG. 1C and also shown in FIGS. 6A and 6B, a portion of the sides may have a transparent window 54*a* within an opaque frame 54*b* which allows the liquid interior 14 to be visible to the marksman.

FIGS. 1A-1D illustrate the target in a pouch embodiment. The target is comprised of a flexible material 32 that allows the marksman to adjust the target as needed. The base is further comprised of a gusset 42 that is attached about the periphery at the bottom end of the body 100 to provide further stabilization so the target 10 can stand on its own. The gusset 42 also connects the front ply 34*a* and the back ply 34*b* at their bottom end 18. The side ends 36 of the plies 34 are sealed with side edge seals 46, and the strip 38 at the top 16 is sealed with a top edge seal 40. The strip 38 extends the length of the top 16 of the target and provides a surrounding structure for the aperture 12. As indicated in FIG. 1D, the apertures could be an optional feature for the target. Additionally, the target could be provided as a part of a target kit system in which the target 10 is used in combination with stickers having different shapes, colors and/or alphanumeric characters. The stickers that can be used with the target in a target kit are described below with reference to FIGS. 3A and 3B.

Figure 2:
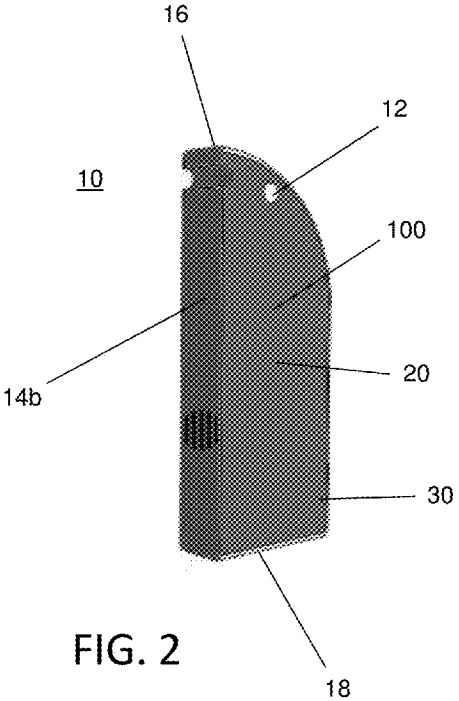
FIG. 2 shows the internal indicia in a cross-section view of a rigid target.
Figure 4B:
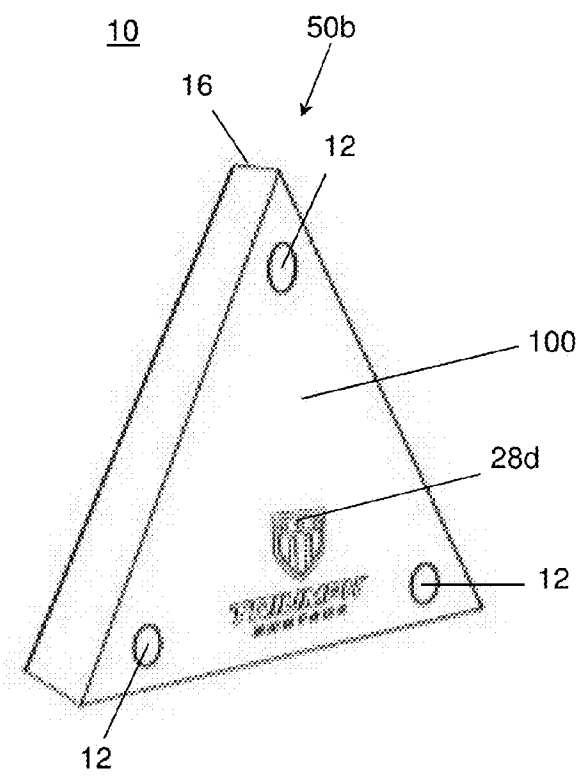
FIGS. 4A-4D show various shapes of the rigid target.
Figure 4A:
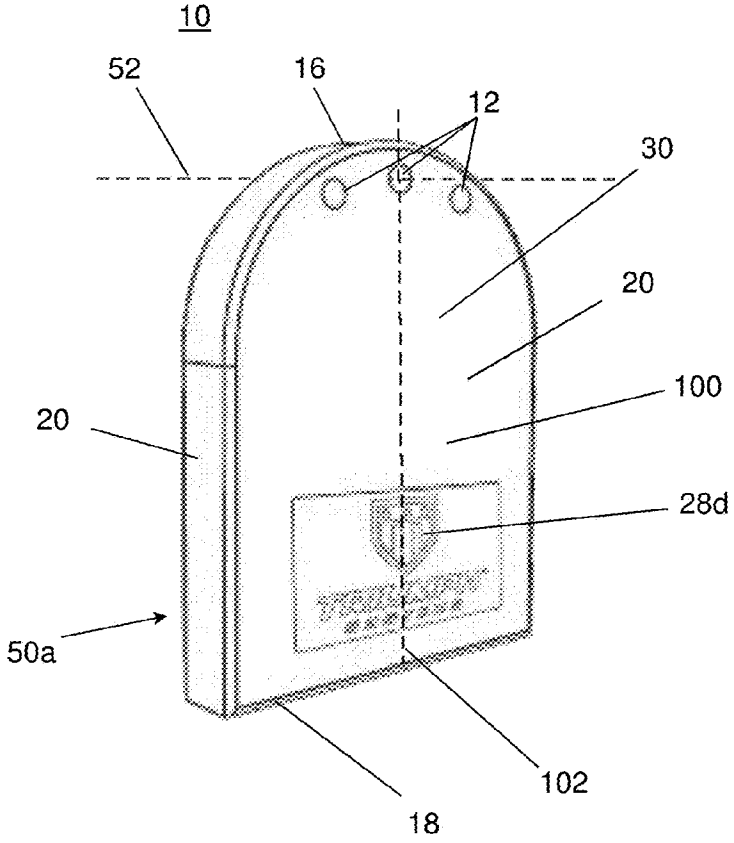
Figure 4D:
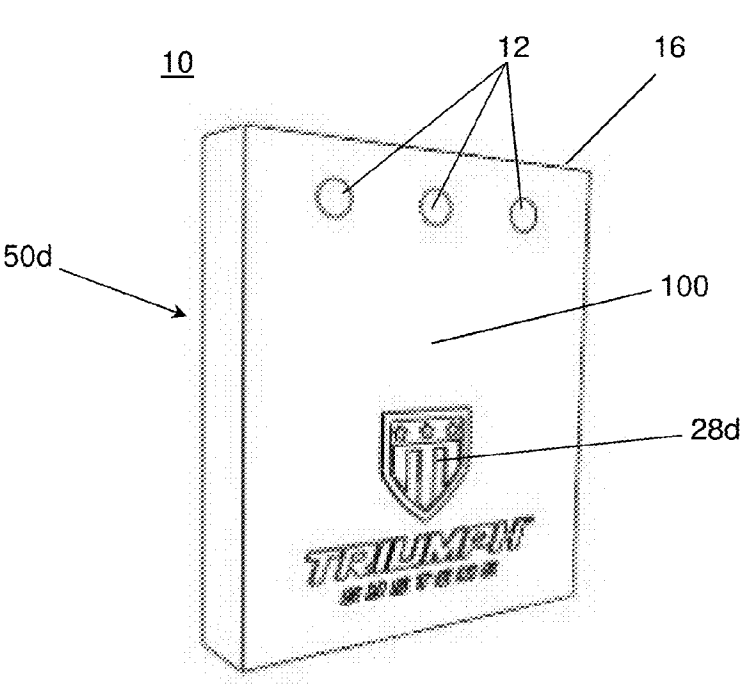
Figure 4C:
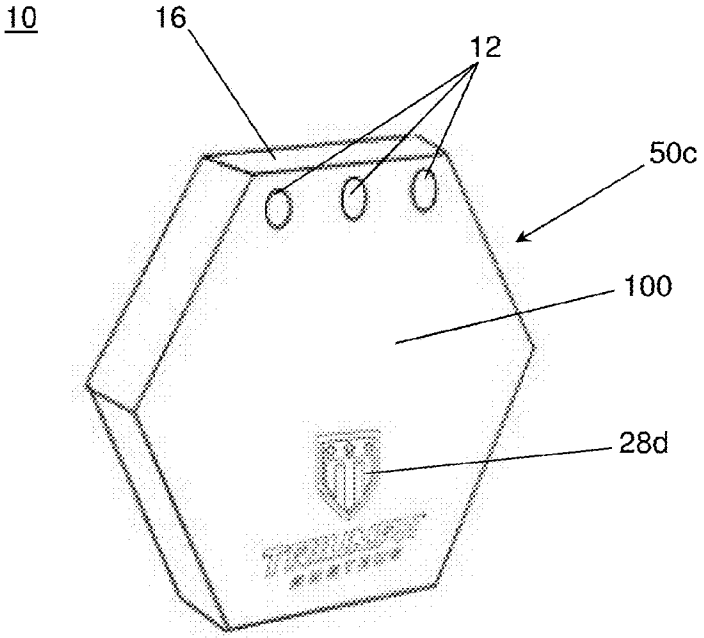

FIGS. 2, 4A-4D, 5A, and 5B show embodiments of the target comprised of a rigid material 30. The rigid targets may be solid throughout the interior as shown in FIG. 2 or may be a rigid shell surrounding and sealing a liquid or solid particulates within the interior space. Similar to the flexible membrane target discussed above, the rigid walled target has a top portion 16 that surrounds one or more apertures 12. The aperture 12 of the rigid target is located proximate to the top 16 of the target on an axis 52 perpendicular to the centerline 102 of the body 100. For the solid target, the interior is preferably clay that is colored to distinguish the targets from others upon impact. As with the other embodiments, the target has a flat base 18, and it can also be attached or suspended from an object by using the aperture 12.

FIGS. 3A and 3B show a variety external indicia 24 that can be printed on stickers 44 or directly on the outer surface of the target bodies. The indicia can be alphanumeric characters, i.e., letters (A, B, C) and/or numbers (1, 2, 3) 26. The indicia can also take the form of a variety of shapes 28 and/or colors 48. For example, the shapes 28 of the external indicia can include a circle 28*a*, square 28*b*, triangle 28*c*, and a logo 28*d*. Bright colors are preferably used for the background of the shapes 28, such as magenta 48*a*, green 48*b*, and yellow 48*c*. The alphanumeric character stickers 44*a* are preferably smaller than the stickers 44*b* with different shapes and colors, allowing the alphanumeric stickers to be layered on top of and adhered to the larger stickers 44*b*. FIGS. 4A-4D illustrate the target as it may be formed in different target shapes 50, such as an arch 50*a*, a triangle 50*b*, a hexagon 50*c*, and a square 50*d*. The different shaped targets or different shaped stickers placed on targets having the same shape can provide a marksman with differentiated targets for cognitive shooting drills.

The different combinations of targets and stickers with the different shapes, colors, and alphanumeric characters result in a target system that enhances cognitive shooting drills. The targets are multi-variable, highly responsive training platforms with customizable colors, shapes, and alphanumeric characters on stickers that are part of a target kit. The shooting targets create increased marksmanship by including discretionary shooting and engaging the target until it has been fully neutralized. The target provides a marksman with instant feedback, and increases training experience, especially for new marksman. Preferred embodiments of the targets include variations of colors of liquid (red, blue, and yellow), shapes, both target shape 50 (arch 50*a*, triangle 50*b*, hexagon 50*c* or square 50*d*) and external indicia shape 28 (circle 28*a*, square 28*b*, triangle 28*c*, or logo 28*d*), and alphanumeric characters 26. A marksman chooses target shapes and colors or the same target shape and color can be used with stickers having different shapes and colors. The marksman can also select different alphanumeric characters for the targets.

Once the targets are prepared with different shapes and alphanumeric characters, the marksman sets the targets at a distance away. The marksman, or another marksman, calls out any combination of the color 48, shape 28, or alphanumeric characters 26. The marksman must first identify the called-out target with the corresponding indicia and then neutralize the simulated threat posed by the target. Confirmation that the threat is neutralized is given by visual confirmation of the internal indicia 14 when the target is in a fractured state 10*b*. The call outs continue until all threats are neutralized.

In cognitive shooting drills using the target system of the present invention, targets are provided, and each target has a body with an internal indicia. Stickers are adhered to the exterior of the body for each target to serve as an external indicia that uniquely identifies each one of the targets. The targets are positioned a distance away from a marksman that has a firearm. The marksman is provided with a combination of a shape, color and an alphanumeric character that defines a particular target, and the marksman aims the firearm at the defined target and discharges a projectile at the defined target from the firearm. The visual internal indicia provides a confirmation of impact as an visual impact indicator. As each target is impacted, a different target is defined by another combination and the marksman again shoots at the newly defined target. This process is repeated until all of the targets have been impacted.

Figure 7:
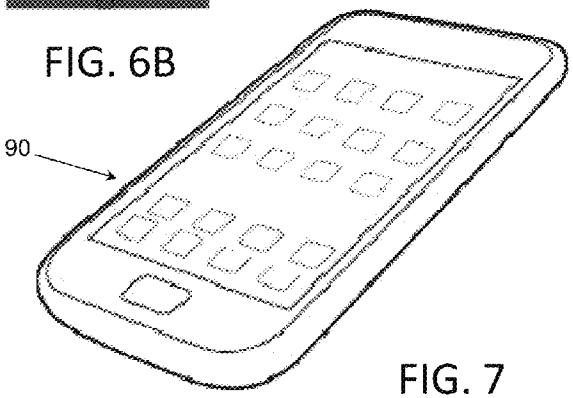
FIG. 7 shows a mobile smart-phone running a cognitive shooting drill application.

FIG. 7 illustrates a different variation of the call out method. As described, traditionally the call outs are made by another marksman or by the marksman themselves. According to another aspect of the present invention, an application installed on a mobile device 90 is used to perform the call-outs. The target variables being used during a drill (i.e., particular combinations of shapes, colors, and/or alphanumeric characters) can be entered into the application, and the application can then perform the call-outs for the corresponding variable combinations that identify the targets. It is also possible for the application to include in the call-outs variable combinations that do not identify any of the targets, in which case the marksman should refrain from shooting at any of the targets.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A target for shooting, comprising:

a body comprising an interior, an exterior, a top, a base surface, and a plurality of sides, wherein the sides extend from the base surface to the top, wherein the body has a centerline located between the sides and extending from the base surface to the top, wherein the body is comprised of an impact-fracturable material, wherein the body has an intact state and a fractured state, an aperture extending through the body between the sides at a location proximate to the top of the body, wherein the aperture has an axis substantially perpendicular to and intersecting with the centerline of the body below the top of the body; wherein the sides are flexible and are comprised of a front ply and a back ply, wherein the front ply and the back ply each has an interior side, an exterior side, a pair of side ends, a top end, and a bottom end, wherein the front ply is comprised of a transparent section and an opaque frame surrounding the transparent section, wherein the side ends of the front ply and the back ply are attached to each other from the top end to the base surface defining a pair of side edge seals, wherein the base surface is further comprised of a bottom gusset extending between and connecting the front ply and the back ply at the bottom end, wherein the top end of the front ply has a front strip extending between the pair of side ends and surrounding the aperture, wherein the top end of the back ply has a back strip extending between the pair of side ends and surrounding the aperture, wherein the front strip and the back strip are attached to each other along the top of the body defining a top edge seal, and wherein the pair of side edge seals, the top edge seal and the bottom gusset form a perimeter seal around the interior of the body; and an internal indicia located within the interior of the body, wherein the internal indicia is exposed to the exterior of the body in the fractured state, wherein the internal indicia is further comprised of a colored liquid, and wherein the colored liquid is visible through the transparent section of the front ply in the intact state.

2. The target of claim 1 further comprising an external indicia on one of the sides at the exterior of the body, wherein the external indicial is selected from the group of indicia consisting of a shape, a color, and an alphanumeric character.

3. The target of claim 1, wherein the external indicia is comprised of an alphanumeric sticker.

4. The target of claim 3 further comprising a base sticker, wherein the base sticker is comprised of a shape and a color, wherein the base sticker is attached to the exterior of the body, and wherein the alphanumeric sticker is smaller than the base sticker and is applied over the base sticker.

5. The target of claim 1, wherein the internal indicia is further comprised of a pressurized gas.

6. The target of claim 5, further comprising an inflated pouch within the body, wherein the pressurized gas is contained within the inflated pouch.

7. The target of claim 1, further comprising a sticker sheet with a plurality of stickers, wherein a first one of the stickers has a first position attached to the sticker sheet, a second position detached from the sticker sheet, and a third position applied to one of the sides at the exterior of the body.

8. The target of claim 1, further comprising at least one of an alphanumeric sticker and a preprinted alphanumeric character over a portion of the transparent section of the front ply.

9. The target of claim 1, further comprising a pair of apertures extending through the body on opposite sides of the aperture with the axis intersecting with the centerline.

10. A target for shooting, comprising:

a body comprising an interior space, a top section, a base surface, and a plurality of sides, wherein the sides extend from the base surface to the top section, wherein the body has a centerline located between the sides and extending from the base surface to the top section, wherein the body is comprised of an impact-fracturable material, wherein the sides are comprised of a front ply and a back ply and are comprised of a flexible material, wherein the front ply is comprised of a transparent section and an opaque frame surrounding the transparent section, wherein the front ply and the back ply each has an interior side, an exterior side, a pair of side ends, a top end, and a bottom end, wherein the side ends of the front ply and the back ply are connected to each other from the top end to the base surface defining a pair of side seals, wherein the top end of the front ply and the top end of the back ply are connected to each other along a strip along the top section of the body and between the side ends defining a top seal, wherein the base surface is further comprised of a bottom gusset and extends between and connects the front ply and the back ply at the bottom end to form a bottom seal, wherein the pair of side seals, the top seal and the bottom seal form a perimeter seal around the interior space of the body, and wherein the body has an intact state and a fractured state;

an aperture extending through the body between the sides in the strip along the top section of the body above the interior space of the body, wherein the aperture has an axis substantially perpendicular to and intersecting with the centerline of the body within the strip along the top section of the body;

a colored material sealed within the interior space of the body when the body is in the intact state, wherein the colored material is exposed to the exterior side of the front ply and the back ply when the body is in the fractured state, wherein the colored material is a colored liquid, and wherein the colored liquid is visible through the transparent section of the front ply in the intact state; and a sticker adhered onto the front ply, wherein the sticker comprises at least one of a shape and an alphanumeric character, and wherein the sticker is an alphanumeric sticker applied over a portion of the transparent section of the front ply.

11. The target of claim 10, further comprising a pressurized gas within the body.

12. The target of claim 10, further comprising a pair of apertures extending through the body on opposite sides of the aperture with the axis intersecting with the centerline of the body.

13. The target of claim 11, further comprising a set of stickers comprised of a sticker sheet with a plurality of alphanumeric character stickers, wherein the alphanumeric character sticker applied over the portion of the transparent section has a first position attached to the sticker sheet and a second position detached from the sticker sheet.

14. A target kit for shooting, the kit comprising:

a body comprising an interior, an exterior, a top, a base surface, and a plurality of sides, wherein the sides extend from the base surface to the top, wherein the body has a centerline located between the sides and extending from the base surface to the top, wherein the body is comprised of an impact-fracturable material, and wherein the body has an intact state and a fractured state, wherein the sides are flexible and are comprised of a front ply and a back ply, wherein the front ply and the back ply each has an interior side, an exterior side, a pair of side ends, a top end, and a bottom end, wherein the front ply is comprised of a transparent section and an opaque frame surrounding the transparent section, wherein the side ends of the front ply and the back ply are attached to each other from the top end to the base surface defining a pair of side edge seals, wherein the base surface is further comprised of a bottom gusset extending between and connecting the front ply and the back ply at the bottom end, wherein the top end of the front ply has a front strip extending between the pair of side ends, wherein the top end of the back ply has a back strip extending between the pair of side ends, wherein the front strip and the back strip are attached to each other along the top of the body defining a top edge seal, and wherein the pair of side edge seals, the top edge seal and the bottom gusset form a perimeter seal around the interior of the body;

a colored material located within the interior of the body, wherein the colored material is exposed to the exterior of the body in the fractured state, wherein the colored material is further comprised of a colored liquid, wherein the colored liquid is visible through the transparent section of the front ply in the intact state; and a first sheet of stickers, wherein the stickers have a first position attached to the first sheet and a second position detached from the first sheet, wherein the stickers in the first sheet are in the form of alphanumeric characters, and wherein an alphanumeric sticker from the first sheet is moved from its first position to its second position and is moved from its second position to a location attached to a portion of the transparent section of the front ply.

15. The target kit of claim 14, further comprising a pressurized gas within the body.

16. The target kit of claim 15, further comprising an inflated pouch within the body, wherein the pressurized gas is contained within the inflated pouch.

17. The target kit of claim 14, further comprising an aperture extending through the body between the sides at a location proximate to the top of the body, wherein the aperture has an axis substantially perpendicular to and intersecting with the centerline of the body below the top of the body, and wherein the colored material is at least one of a colored liquid and a colored solid.

18. The target kit of claim 14, wherein the stickers in the first sheet are in the form of alphanumeric characters, and wherein an alphanumeric sticker from the first sheet is moved from its first position to its second position and is moved from its second position to a location on the exterior of the body at one of the sides.

19. The target kit of claim 18, further comprising a second sheet of stickers, wherein the stickers in the second sheet have at least one of a plurality of different colors and a plurality of different shapes, wherein the alphanumeric characters in the first sheet are smaller than the stickers in the second sheet, wherein at least one of the stickers from the second sheet is attached to the location on the exterior of the body, and wherein the alphanumeric sticker is applied over a portion of the sticker from the second sheet attached to the location.

20. The target kit of claim 14, further comprising a plurality of bodies, wherein a first body has a first shape and a second body has a second shape, and wherein the stickers in the first sheet are in the form of at least one of a set of alphanumeric characters, a set of colors, and a set of shapes.

* * * * *